United States Patent [19]

Jenkins

[11] Patent Number: 4,825,353

[45] Date of Patent: Apr. 25, 1989

[54] CONTROL OF REACTANTS IN CHEMICAL ENGINEERING SYSTEMS

[75] Inventor: David P. Jenkins, Gryant, Wales

[73] Assignee: British Steel Corporation, England

[21] Appl. No.: 895,879

[22] Filed: Aug. 12, 1986

[30] Foreign Application Priority Data

Aug. 30, 1985 [GB] United Kingdom ..... 8521663

[51] Int. Cl.[4] ..... G05B 13/00

[52] U.S. Cl. ..... 364/152; 364/513

[58] Field of Search ... 364/152, 163, 513, 200 MS File, 364/900 MS File

[56] References Cited

U.S. PATENT DOCUMENTS

| | | | |
|---|---|---|---|
| 3,960,320 | 6/1976 | Slater | 364/153 |
| 4,130,863 | 12/1978 | Schweitzer | 364/158 |
| 4,236,218 | 11/1980 | Killebrew | 364/152 |
| 4,489,376 | 12/1984 | Putnam | 364/165 |

OTHER PUBLICATIONS

"Automatic Control Ups Heater Combustion", Oil and Gas Journal, vol. 79, No. 38, Sep. 1981.

*Primary Examiner*—Allen MacDonald

*Attorney, Agent, or Firm*—Steele, Gould & Fried

[57] ABSTRACT

The invention provides an arrangement of controlling reactants in a chemical engineering system comprising feeding to a background electronic logic control circuit analysis signals with respect to the operation of the reactants in the reaction for interpretation therein; drawing conclusions as would a field technologist, implementing experiments from these conclusions to improve the efficiency, and if greater efficiency is achieved, feeding interpreted data signals with respect thereto from the background logic circuit to a data file; feeding data signals from the data file to a foreground electronic logic circuit together with signals relating to the activity level of the reaction and the physical conditions of the incoming supply of at least one reactant to the reaction; the foreground logic circuit controlling the flow of one or more reactants to the reaction on the basis of the signals received thereby.

17 Claims, 3 Drawing Sheets

CONTROL OF REACTANTS IN CHEMICAL ENGINEERING SYSTEMS

BACKGROUND

This invention relates to the control of reactants in chemical engineering systems. More particularly but not exclusively this invention relates to the control of burners such as multiple burner systems.

As used herein the expression multiple burner systems includes unitary apparatus such as furnaces, having a multiplicity of burners and, in addition, plant incorporating a multiplicity of burners for a plurality of separate but related apparatus, such as a plurality of shell boilers each of which is provided with twin burners and combustion chambers in which the flues are provided with trunking to a common exhaust stack.

For the reduction of pollution and for the economic efficiency of the operation of such multiple burner systems, it is desirable to control the burners at all levels of their firing so as to provide each burner with an air/fuel ratio at approximately stoichiometric or any other desired condition.

In practice, however, considerable problems arise in attempting to obtain control of individual burners, and waste gas analysis hitherto shows only the overall air/fuel ratio and not that of individual burners, so that a control system relating to the overall waste gas analysis has not, in practical terms, provided optimum conditions for any but a few burners out of the multiplicity.

In addition in the case of furnaces attempts to provide such an overall analysis control system have tended to lead to instability problems due to an interaction between the required furnace temperature control and the stoichiometric control loop.

It is an object of the present invention to overcome or at least significantly reduce the above mentioned problems.

OBJECTS AND SUMMARY OF THE INVENTION

According to one aspect of the present invention there is provided a method of controlling reactants in a chemical engineering system comprising feeding to a background electronic logic control circuit analysis signals with respect to the operation of the reactants in the reaction for interpretation therein; feeding interpreted data signals with respect thereto from the background logic circuit to a data file; feeding data signals from the data file to a foreground electronic logic circuit together with signals relating to the activity level of the reaction and the physical conditions of the incoming supply of at least one reactant to the reaction; the foreground logic circuit controlling the flow of one or more reactants to the reaction on the basis of the signals received thereby.

According to another aspect of the present invention there is provided apparatus for controlling the reactants in a chemical engineering system comprising a background electronic logic circuit adapted and programmed to receive and interpret analysis signals with respect to the operation of the reactants in the reaction, and to output data signals with respect thereto to a data file; and a foreground electronic logic circuit adapted and programmed to receive data signals from the data file, and signals relating to the activity level of the reaction, and the physical conditions of the incoming supply of at least one reactant to the reaction; and means for controlling the flow of one or more reactants to the reaction adapted to be controlled by the foreground logic circuit on the basis of the signals received thereby.

According to a further aspect of the present invention there is provided a method of controlling the operation of a plurality of burners in a multiple burner system comprising feeding to a background electronic logic control circuit analysis signals with respect to the operation of the burners for interpretation therein; feeding interpreted data signals with respect thereto from the background logic circuit to a data file; feeding data signals from the data file to a foreground electronic logic circuit together with signals relating to the level of burner firing and the physical conditions of the incoming air supply to the burners, the foreground logic circuit controlling air and/or fuel flow to each of the burners on the basis of the signals received thereby.

According to yet another aspect of the present invention there is provided apparatus for controlling the operation of a plurality of burners in a multiple burner system comprising a background electronic logic circuit adapted and programmed to receive and interpret analysis signals with respect to the operation of the burners, and to output data signals with respect to each burner to a data file; and a foreground electronic logic circuit adapted and programmed to receive data signals from the data file, and signals relating to the level of burner firing, and the physical conditions of the incoming air supply to the burners; and means for controlling the air and/or fuel flow to each of the burners adapted to be controlled by the foreground logic circuit on the basis of the signals received thereby.

The background logic circuit may be arranged to carry out a logical progression of experiments as would a fuel technologist to optimise the stoichiometry of each burner, and, if improvement is effected, to save in a data file the optimised setting (e.g. valve settings) for each burner with respect to:

(i) firing level;

(ii) whether the firing level was risen to or fallen to;

(iii) the air conditions of temperature, pressure and humidity.

Thus, the circuit is programmed to calculate thermal efficiency from the signals received. Also saved is the magnitude of the next experiment to be carried out on that burner. In this way the system is progressively optimised in a heuristic fashion, the teleoligical goal being peak efficiency of the system.

If a change occurs in the firing level or the air conditions, the foreground logic circuit consults the data files assembled by the background logic circuit and, without waiting for further data input, sends signals to the burner control valves to position them at the positions previously determined by the background logic circuit as being those of the peak efficiency so far determined for those conditions of firing level and physical air condition. Control is then passed back to the background circuit for further optimisation experiments.

The foreground and background logic circuits may be part of a digital computer with an operating system commonly known as "foreground/background", together with the relevant interfaces to interpret signals from the instrumention and to send control signals to a control system. The foreground system is arranged and programmed to take precedence over the background system, and it can be arranged that the foreground interrupts the background under certain defined conditions.

Such a computer may receive firing level signals with respect to each of the burners and signals concerning the oxygen (or, alternatively, Carbon Dioxide) and Carbon Monoxide levels in the waste gases to the chimney. These latter two signals may be given by gas analysis equipment.

Additionally, air pressure together with wet and dry bulb temperatures, or other means of humidity detection, may be measured. The signals from the transducers may be interpreted in the computer to give a relative potential oxygen mass flow to the system at that time.

The computer may send signals to air trimming valves, one of which may be provided for each burner to enable its' individual air flow to be controlled finely.

The foreground logic may additionally receive signals related to the direction of movement of the level of firing and the fuel pressure and temperature and utilise such signals in the production of its output. Analysis of performance of the burners for the background control logic may be provided by a straightforward analysis of the waste gas composition or, alternatively, can be provided by a logical subroutine by individual variation of the burners and analysis, for example by an infra-red analyser, of the resultant effect upon the overall exhaust fume content.

The analysis of the burner performance may be in relation to specific ranges of combustion results.

BRIEF DESCRIPTION OF THE DRAWINGS

In order that the invention may be more readily understood, one embodiment thereof will now be described by way of example with reference to the accompanying drawings in which:-

DETAILED DESCRIPTION

Figure 3:
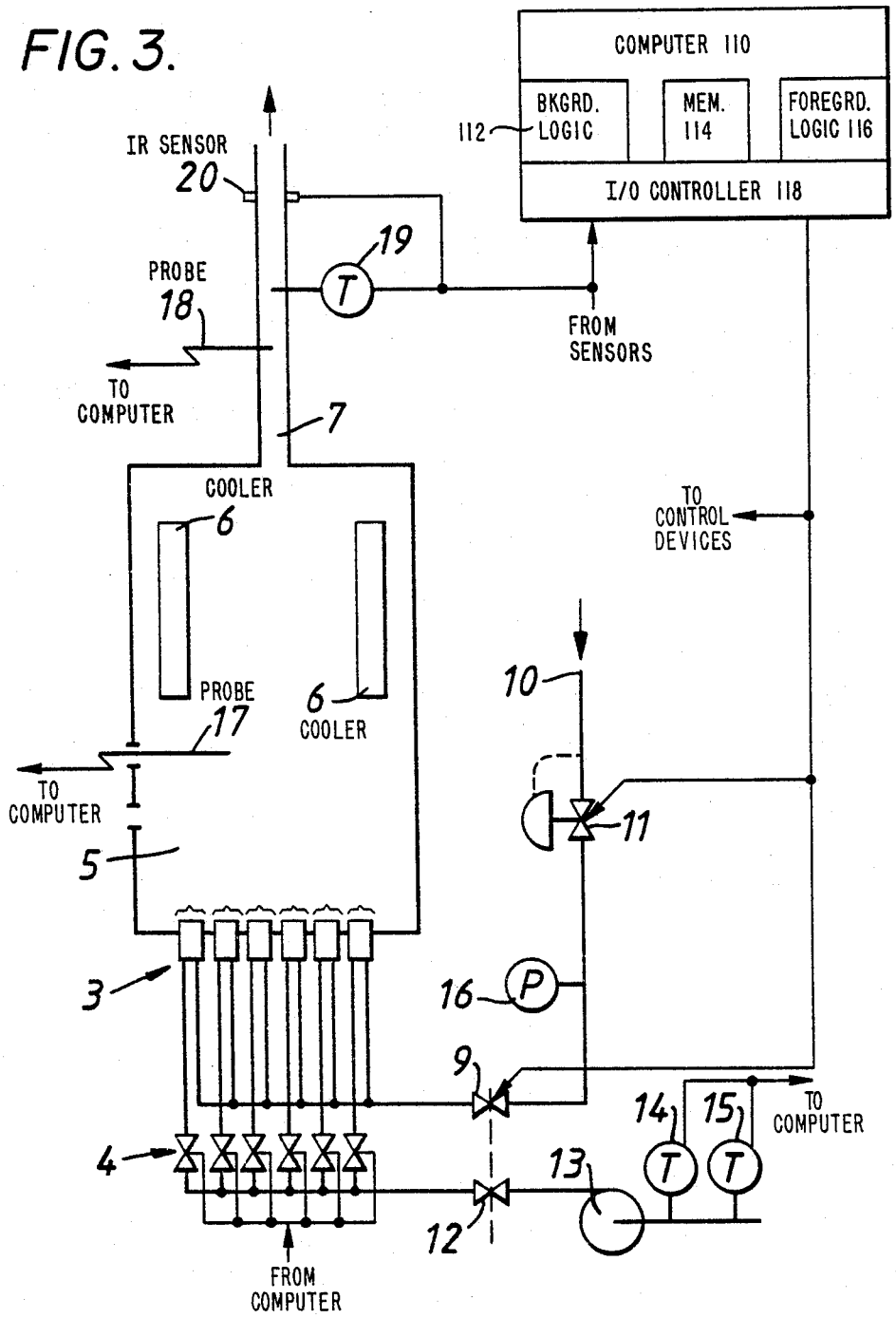
FIG. 3 is a diagrammatic or schematic view of an experimental furnace utilising the arrangement of the invention.

The furnace of FIG. 3 essentially comprises a furnace chamber 5 having water cooling panels 6, an exhaust 7 leading to a chimney (not shown) and six separate burners 3. The burners are supplied via a single firing level control valve 9 to a source of fuel such as propane 10, with a pressure control valve 11 in the line. The burners are also connected via separate air trim butterfly valves 4 and a firing level control valve 12 to an air supply fan 13. Control valve 9, pressure control valve 11, air trim butterfly valves 4 and firing level control valve 12 are all controlled by computer 110. The computer includes background logic 112, memory 114, foreground logic 116 and input/output controller 118. Wet and dry thermocouples 14 and 15 are connected to the input to the air fan 13.

The fuel pressure is measured at 16.

A movable sampling probe 17 within the experimented furnace is capable of analysis of the operation of each burner 4.

The exhaust stack is provided with a Zirconia Oxygen probe 18, a thermocouple 19 and a cross-stack carbon monoxide (CO) infra-red analyser 20. Computer 110 obtains signals from thermocouples 14 and 15, fuel pressure meter 16, sampling probe 17, oxygen probe 18 and infra-red analyzer 20. These signals are utilized in the analysis of the chemical reaction by the various functional components of the computer as described hereinafter.

Physically, the control of the excess air to each burner 3 is by means of a supplementary butterfly 4, or other valve, depending on combustion air supply pipe diameters. If electrical actuation is used, an analogic feedback position signal is provided. Provision for failing safe in the fully open position is provided no matter what the motive power of the valves.

Figure 1:
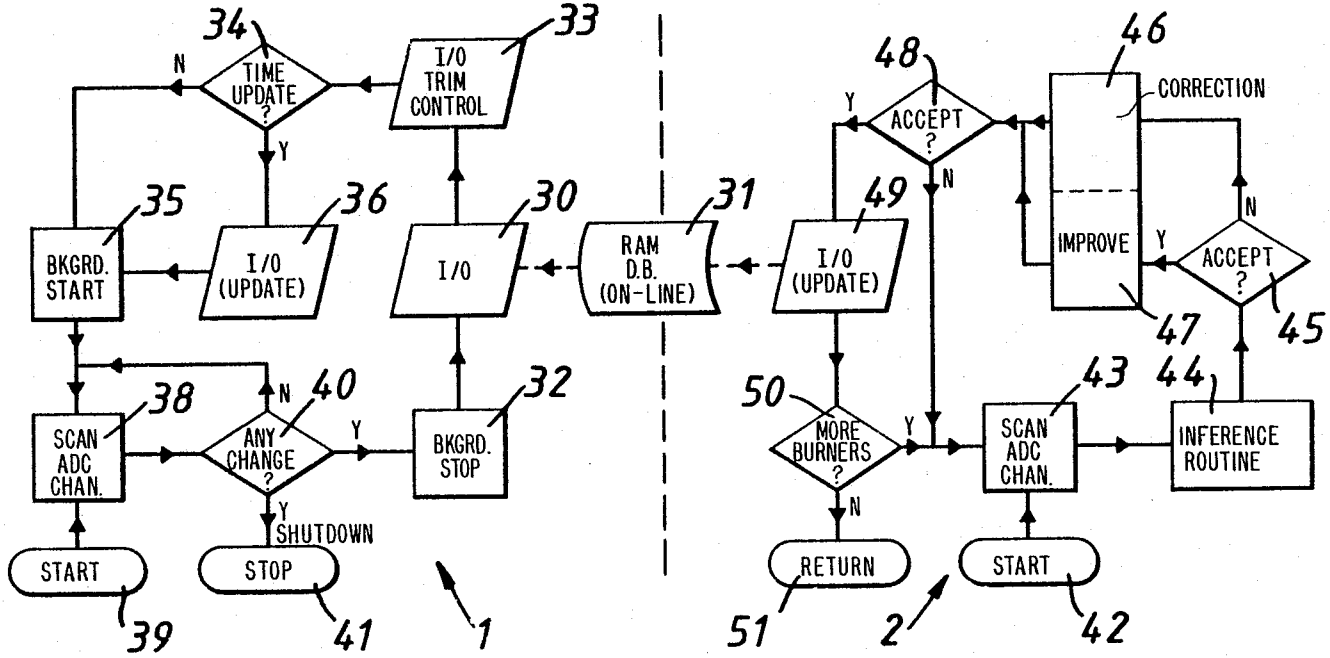
FIG. 1 is a diagram showing the operational concepts involved in the foreground and background logic.
Figure 2:
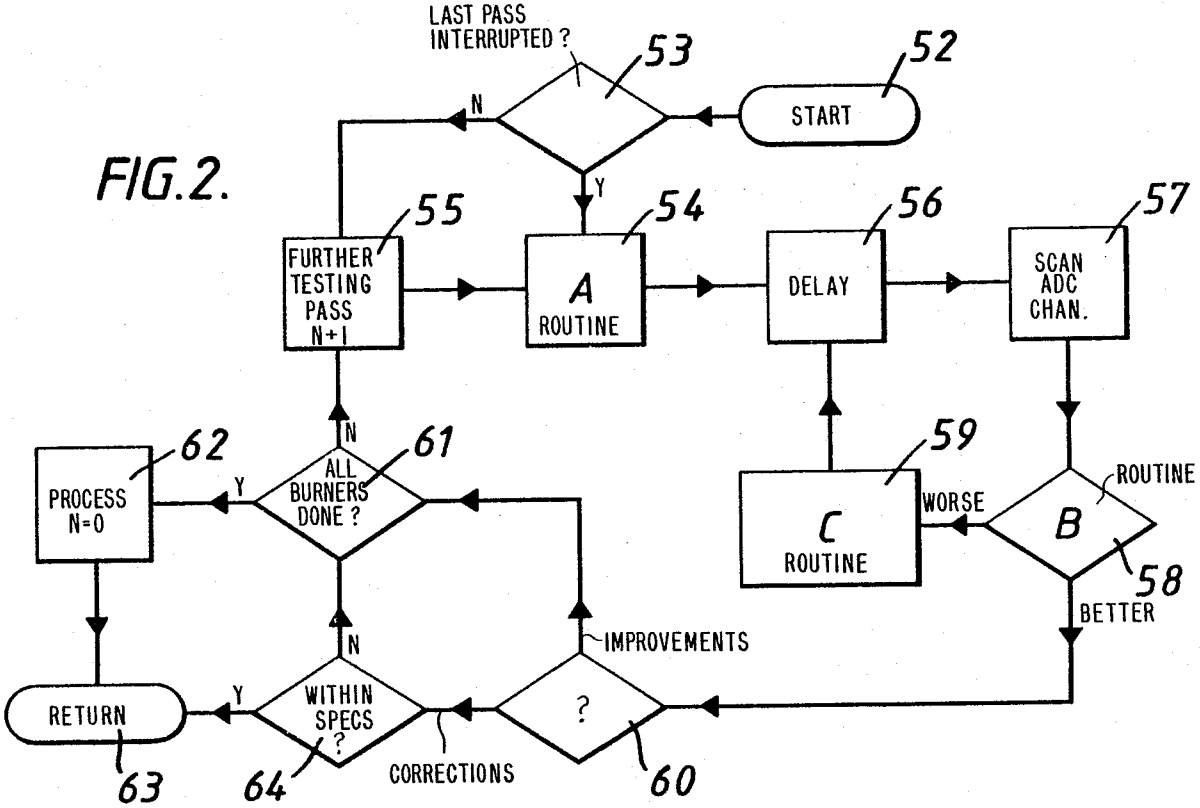
FIG. 2 is a diagram illustrating the routine operated in the background logic updating its information.

In terms of software, the control programme is outlined in greatly simplified form in FIGS. 1 and 2. It largely follows the type of programme called an "Expert System". As can be seen the operating system has a foreground logic circuit 1 and a background logic circuit 2. This can conveniently be considered as two processors sharing common Random Access Memory (RAM). The foreground circuit gives a rapid response to a change in firing level, whilst the background circuit logically optimises the burner stoichiometry between changes in firing level, and sets new goals for a goal-seeking part of the software to aim at. The background circuit is overriden by the foreground circuit on receipt of firing level or physical air condition changes.

Very simply stated, the foreground logic circuit comprises an input/output 30 which receive data from the background logic circuit via an RAM data base online store 31 and a "stop background circuit" decision step 32. Input/output 30 feeds to a further input/output 33, which, on the basis of information received from the data base 31 outputs instruction to alter all trim controls for the burners to the last best practice. From input/output 33 a decision step 34 is fed which reacts on whether a predetermined update time period has passed. A negative response is fed to a process step 35 controlling the starting of the background logic circuit 2. A positive response is fed to an input/output 36 which updates programme disk files from the RAM data base 31 and then, in turn, feeds to the process step 35. The process step 35 controls a further process step 36 enabling ADC (Analog to Digital Converter) channels to be scanned in dependence on the start terminal point 39, and a negative feedback response from an "any change" decision step 40. Positive response from the decision step 40 provides an input back into the background logic circuit process step 32, whilst a combustion shut-down output leads to a "stop" action at the terminal point 41.

In similar manner, the background logic circuit 2, upon initiation at terminal point 42 of "start", involves a process step 43 of scanning ADC (Analog to Digital Converter) channels, information from which then passes to an inference routine process step 44 (described in detail later) results of which pass to a results acceptable decision step 45. A negative output from decision step 45 passes to a correction routine process 46 (described in detail later), whilst a positive output from the decision step 45 passes an improvement routine step 47. The outputs from steps 46 and 47 pass to a "results acceptable" decision step, negative output from which is returned to the "scan ADC channels" process step 43, whilst positive output is fed to an input/output 49 for updating the on-line store 31. Also an output 49 controls a further decision step 50 concerning whether there are any more burners. A yes response leads back once more to the process step 43, whilst a no response leads to a return terminal point 51.

Having described briefly the operation in total, but in greatly simplified form, of both background and the foreground logic circuitry, salient features thereof will now be described in greater detail.

The primary mode of foreground logic control circuit 1 is one of feed-forward signals to each air trimming butterfly valve 4. The level of these signals is determined by examination of a database whose compilation is discussed later. The real-time factors which determine the selection of the signal level from the data base are:-

(i) Level of firing
(ii) Temperature, pressure and humidity of the air
(iii) Direction of movement of the level of firing
(iv) Fuel pressure and temperature in the case of a gas.

The firing level is a most important factor, since it is the parameter which is varied most frequently. Burners commonly have different excess air requirements at different firing levels and, additionally, the butterfly control valve characteristics will be different at varying flow rates.

The temperature, pressure and humidity of the air are important since they affect the mass of oxygen which a fan will pass.

The direction of the alteration is important mainly in terms of worn control linkages which can thus be compensated for. The compensation also alters automatically with gradual wear.

It can be seen from FIG. 1 that the purpose of the background logic control circuit 2 of the programme is to supply, update and improve the data set which the foreground logic circuit 1 uses in its feedforward control.

This section (background logic circuit 1) of FIG. 1 is a demonstration of the concepts involved more than the actual computer programme steps, which have been excessively simplified to show the concepts.

The background logic involves essentially:-

(i) Scanning the analog channels 1, the sampling probe signals and the interpretation of the results in terms of percentage oxygen and parts per million carbon monoxide (or percentage carbon monoxide and parts per million oxygen if the system is aplied to non-oxidising or reducing atmosphere furnace).
(ii) The inference sub-routine. This diagnoses probable faults from the analyses for use by one of several corrective routines or the improvement routine.
(iii) The corrective routines. These set out by trial and error, to trace and correct the faulty burner or burners. These routines vary in terms of whether the firing is too rich or too lean and to what degree. If the results are well within specification, however, the objectives of the control system, in terms of allowable flue gas oxygen content, are tightened. This "learning" of the system's capabilities and seeking new goals are the heuristic and teleological sections of the programme respectively.
(iv) The Improvement Routine This is a variation on the "too lean" routine, except that the incremental changes are very small.
(v) The RAM update. This is only done if there is an overall improvement in performance. If the improvement routine was interrupted by the foreground, then the results are discarded, but a note is made of the burner numbers so that the routine begins with that burner (but from "start") when next that firing level is encountered and the improvement is implemented.
(vi) The "any more burners"? This question is only asked if the improvement routine was called last in preference to the correction routine. If the latter was last called, then the automatic answer to this question is "yes".

The following sub-routines are followed in the background logic.

(a) An inference routine in which the scan of the analysers will give two of six possible results in terms of acceptable range (AR):

| Results | Truth Symbol |
|---|---|
| Oxygen over AR | OO |
| Oxygen within AR | OW |
| Oxygen under AR | OU |
| Carbon monoxide over AR | MO |
| Carbon monoxide within AR | MW |
| Carbon monoxide under AR | MU |

From this, the following inferences may be drawn:

1 If MU and OU are true, then all the burners are capable of burning at lower excess air.
2 If MU and OW are true, then one or probably more burners are slightly too lean.
3 If MU and OW are true, then most, probably, all, of the burners are too lean.
4 If MW and OU are true, then as 1, but to a lesser extent.
5 If MW and OW are true, then stoichiometry is possibly correct.
6 If MW and OO are true, then at least one, possibly more, of the burners is too lean.
7 If MO and OU are true, then at least one burner, and probably more, is too rich.
8 If MO and OW are true, then at least one burner, probably not more, is too rich.
9 If MO and OO are true, then at least one burner, possible not more, is too lean, and one burner, possibly not more, is too rich.

The probabilities and possibilities may be quantified in terms of how much the analyses are outside the AR's.

(b) A correction/improvement sub-routine involving, firstly band resetting in which if inferences 1 or 4 result from the analyses, then the top of the oxygen allowability bandwidth is made equal to the oxygen analyses found, i.e., the goals of the teleological process are altered heuristically. No further corrective action is taken except to pass along to the improvement routine.

The remainder of the inferences pass to the improvement section of the correction/improvement subroutine. This sub-routine is expanded and shown in simplified form in FIG. 2. Most simply, the subroutine is initiated from a "start" terminal point 52 leading to a decision step 53 asking "was the last pass interrupted", a positive step leads to a process step 54 (marked A) described in greater detail below. Negative output from the decision step 53 is fed to a process step 55 where a further testing pass is carried out to give a set of N+1, the results of which are then again fed to process step 54. Process step 54 feeds a delay 56 which, in turn, feeds a process step 57 for scanning ADC channels leading to a decision step 58, (marked B) described in greater detail later. A "worse" output from decision step 58 is fed to process step 59 (marked C) again, described in greater detail later, which, in turn, feeds back to delay 56. A "better" output from decision step 58 leads to a "correction or improvement" decision step 60 from which improvements are fed to a further decision step 61 asking "Are all burners done?" A negative response here leads back to process step 55 where an extra pass to provide a set of N+1 is again carried out. A positive response from decision step 61 leads to a process 62 of set N=0 and thence to a return terminal point 63. A correction output from decision step 60 leads to a further decision step 64 asking whether the information received is within or outside the specification. A negative response here leads, again, to the decision 61 as to whether all burners have been investigated, whilst a positive response leads once more to the "return" terminal point.

The steps marked A, B and C behave as follows:-

(i) If inferences 2 or 6 are true, then the action in A is to move burner N slightly richer, B asks whether CO is still within limits and whether oxygen has reduced. If both these are affirmative, then the result is better and the new position of the control valve put into memory. If not, C is carried out which reverses the step A and notes that the increment must be halved next time.

(ii) If inference 3 is true, then (i) above is carried out for all burners simultaneously. If the logic flow passes through C, however, only a fraction of the reverse increment in A is implemented.

(iii) If inference 5 is true, then (i) is carried out with very small increments.

(iv) If inferences 7 or 8 are true, then the course of action is similar to (i) except that each burner is given an increment to the lean side. B then askes whether the CO drops or not as its criterion of better or worse respectively and C is carried out as before.

(v) If inference 9 is true, then (iv) is first carried out only until the rich burner is corrected and then (i) is carried out only until the lean burner is corrected If however this routine is carried out several times in succession, then it is clear that the oxygen AR is set too low, and the AR for oxygen is then raised.

It is appreciated that other Control Factors can be involved. Thus, one problem of optimisation of CO is that final combustion may be delayed giving higher waste gas temperatures (although with theoretically correct analysis) and, therefore, a final improvement routine based on thermal efficiency will be included.

Upon reaching the optimised balanced stoichiometry the system will then attempt small increases in excess air. The purpose of this is to see if the stack temperature can be reduced by a slightly earlier burnout of the CO. An algorithm for calculation of efficiency may be included in the programme for this purpose which will calculate the temperature and excess air effects.

There are further aspects which can be covered in terms of inductive logic. For example, if one burner is found to need adjustment more than others, then it requires very little extra effort in the programme to monitor this and report accordingly.

Although the invention has been described in relation to a multiple burner system, it is to be understood that it is applicable in its generality to other chemical engineering systems for the control of Reactants to and in a reaction. Thus where a chemical reactor has multiple inlets for its reactants so as to improve the mixing of the reactants and provided that the reactants and product can be rapidly measured in the product stream leaving the reactor, then the invention is equally applicable.

I claim:

1. A method for controlling reactants in a reaction in a chemical engineering system comprising:

(a) feeding analysis signals of an operation of the reactants to a background electronic logic circuit for interpretation;

(b) interpreting the analysis signals and outputting interpreted data signals;

(c) feeding the interpreted data signals from the background logic circuit to a data file;

(d) feeding data signals from the data file to a foreground electronic logic circuit together with signals relating to the activity level of the reaction and the physical conditions of an incoming supply of at least one of the reactants to the reaction; and (e) controlling, using the foreground logic circuit, the flow of at least one of the reactions to the reaction based on the signals received by the foreground logic circuit.

2. A method for controlling a plurality of burners in a multiple burner system comprising:

(a) feeding analysis signals of an operation of the burners to a background electronic logic control circuit for interpretation;

(b) interpreting the analysis signals and outputting interpreted data signals;

(c) feeding the interpreted data signals from the background logic circuit to a data file;

(d) feeding data signals from the data file to a foreground electronic logic circuit together with signals relating to the level of burner firing and the physical conditions of a incoming air supply to the burners; and (e) controlling, using the foreground logic circuit, the flow of air and/or fuel to each of the burners based on the signals received by the foreground logic circuit.

3. A method as claimed in claim 2 wherein step (b) comprises producing a logical progression of experimental levels with respect to each burner to optimize the stoichiometry of each burner, and if improvement results, storing in the data file optimised levels for each burner together with corresponding levels for the immediately previous set of experiments, and progressively optimizing burner operation.

4. A method as claimed in claim 3 wherein step (b) further includes storing in the data file the optimised levels for each burner with respect to firing levels of said each burner, data relating to whether the firing level has risen or fallen, and data relating to the air conditions of temperature, pressure and humidity.

5. A method as claimed in claim 2 wherein steps (d) and (e) take precedence over the other steps.

6. A method as claimed in claim 5 including the step of determining when a change occurs in the firing level or the air conditions of the burners step as part of step (d) and setting the burner control valves to a position previously determined in step (b) as being a position of peak efficiency for those firing levels and air conditions, and returning to steps (a) and (b).

7. A method as claimed in claim 2 wherein step (a) includes determining (i) firing level with respect to each of the burners, and (ii) the oxygen or carbon dioxide and the carbon monoxide levels in the burner waste gases.

8. A method as claimed in claim 7 wherein step (e) includes controlling air trimming valves for the burners.

9. Apparatus for controlling reactants in a reaction in a chemical engineering system comprising:

(a) a background electronics logic circuit means for receiving and interpreting analysis signals of an operation of the reactants in the reaction, and for outputting data signals to a data file;

(b) a foreground electronic logic circuit means for receiving the data signals from the data file, for receiving signals relating to an activity level of the reaction, for receiving physical condition signals of an incoming supply of at least one reactant to the reaction, and for generating control signals on the received signals; and (c) means for controlling flow of one or more of the reactants to the reaction based on the control signals.

10. Apparatus for controlling operation of a plurality of burners in a multiple burner system comprising:

(a) a background electronics logic circuit means for receiving and interpreting analysis signals of the operation of the burners, and for outputting data signals with respect to each burner to a data file;

(b) a foreground electronic logic circuit means for receiving the data signals from the data file, for receiving signals relating to a level of burner firing, for receiving physical condition signals of an incoming air supply to the burners, and for generating control signals based on the received signals; and (c) means for controlling flow of air and/or fuel to each of the burners based on the control signals.

11. Apparatus as claimed in claim 10 wherein the background circuit means includes means for generating a logical progression of experimental levels with respect to each burner to optimise the stoichiometry of said burner and if an improvement results, the optimised levels are output as said data signals to said data file.

12. Apparatus as claimed in claim 11 wherein the background electronic circuit means includes means for computing and storing in the data file the optimised levels for each burner which includes a respective firing level; whether the respective firing level has risen or fallen; and air conditions of temperature, pressure and humidity for the air flow.

13. Apparatus as claimed in claim 10 wherein the foreground and background logic circuit means are part of a digital computer with an operating system having a foreground and background system, together with an input/output means for obtaining said analysis signals and for sending said control signals to said means for controlling, the foreground system having means for taking precedence over the background system.

14. A method for controlling the flow of reactants, via a control mechanism, for a chemical reaction comprising:

providing a background electronic logic control circuit, a foreground logic control circuit, and an interlinked data file;

said background circuit:

obtaining process signals representative of said reaction;

interpreting said process signals according to reaction parameters;

diagnosing probable faults with a set of predetermined inferences;

altering said process signals and generating control signals dependent upon the diagnosis step; and storing said control signals in said data file;

the foreground circuit:

obtaining said process signals and determining whether said process signals have changed and if so interrupting said background circuit, obtaining said control signals from said data file; and applying said control signals to said control mechanism.

15. A method for controlling the flow of reactant as claimed in claim 14 including the step of starting the steps in the background circuit after the step of applying said control signals to said control mechanism.

16. An apparatus for controlling the flow of reactants, via a control mechanism, for a chemical reaction comprising:

a background electronic logic circuit means for interpreting, a foreground logic control circuit means for controlling, and an interlinked data file;

said background circuit means including:

means for obtaining process signals representative of said reaction;

means for interpreting said process signals according to reaction parameters and generating interpreted signals;

means for diagnosing probable faults of the interpreted signals with a set of predetermined inferences;

means for altering said process signals and generating control signals dependent upon the diagnosed, interpreted signals; and means for storing said control signals in said data file;

the foreground circuit means including:

means for obtaining said process signals and determining whether said process signals have changed;

means for interrupting said background circuit if said process signals have changed;

means for obtaining said control signals from said data file if said process signals have changed; and means for applying said control signals to said control mechanism.

17. An apparatus as claimed in claim 16 including means for starting said background circuit means after application by said foreground circuit means of said control signals to said control mechanism.

* * * * *